United States Patent [19]

Tomminen

[11] Patent Number: 4,883,416

[45] Date of Patent: Nov. 28, 1989

[54] SLIP-FORM CASTING MACHINE FOR FABRICATION OF ELONGATED CONCRETE PRODUCTS

[75] Inventor: Hannu Tomminen, Nurmijärvi, Finland

[73] Assignee: Parma Oy, Forssa, Finland

[21] Appl. No.: 207,168

[22] Filed: Jun. 15, 1988

[30] Foreign Application Priority Data

Jun. 18, 1987 [FI] Finland ..... 872740

[51] Int. Cl.[4] ..... B28B 1/26

[52] U.S. Cl. ..... 425/64; 425/262; 425/426; 425/427

[58] Field of Search ..... 425/262, 427, 426, 64, 425/381, 382.3, 466

[56] References Cited

U.S. PATENT DOCUMENTS

| | | | |
|---|---|---|---|
| 2,404,464 | 7/1946 | Sewell | 425/262 |
| 3,091,013 | 5/1963 | Robinson | 425/262 X |
| 3,192,292 | 6/1965 | Banks | 425/426 X |
| 3,649,146 | 3/1972 | Moore | 425/427 X |
| 4,133,619 | 1/1979 | Wise | 425/64 |
| 4,205,949 | 6/1980 | Hanson | 425/64 X |
| 4,608,216 | 8/1986 | Barsk | 425/427 X |
| 4,668,447 | 5/1987 | Paakkinen | 425/64 X |
| 4,723,900 | 2/1988 | Vuorenoja | 425/382.3 X |
| 4,755,338 | 7/1988 | Harala | 425/262 X |
| 4,773,838 | 9/1988 | Seppanen | 425/426 X |

FOREIGN PATENT DOCUMENTS

| | | | |
|---|---|---|---|
| 765284 | 6/1934 | France | 425/262 |

*Primary Examiner*—Richard L. Chiesa

*Attorney, Agent, or Firm*—Dellett, Smith-Hill and Bedell

[57] ABSTRACT

The invention concerns a slip-form casting machine for fabrication of elongated concrete products. The slip-form casting machine comprises a feed hooper (1), an auger (6) for exerting pressure onto a concrete mix to be cast, and a casting mold (10, 11). According to the invention, the casting mold (10, 11) is a tubular construction plugged at one end, and the auger (6) is connected to a casting machine body (18) which is substantially complementary with the cross section of the casting mold (10) and is movable with respect to the mold (10) in order to facilitate slip-form casting of a product (7) with an elongated shape in the axial direction of the casting mold. The slip-form casting machine in accordance with the invention produces smooth and high-quality surfaces in concrete products.

4 Claims, 2 Drawing Sheets

FIG.2A 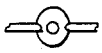 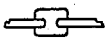 FIG.2B
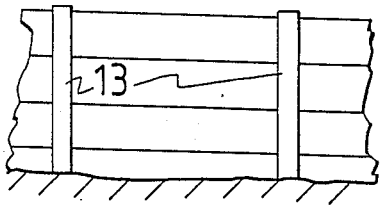
FIG.2
FIG.3A 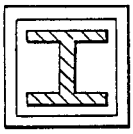
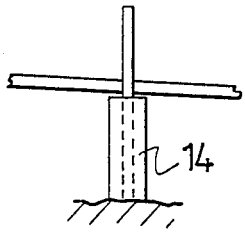
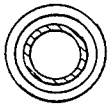
FIG.3 FIG.3B
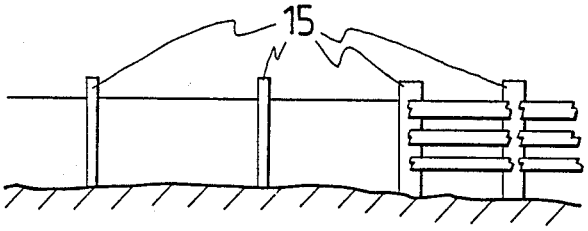
Fig.4
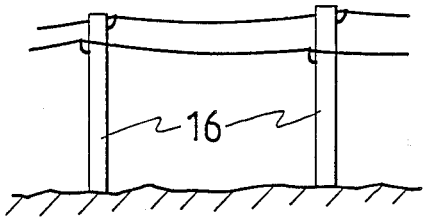
Fig.5
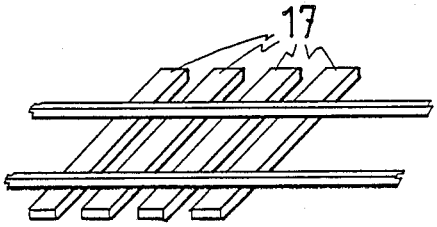
Fig.6

SLIP-FORM CASTING MACHINE FOR FABRICATION OF ELONGATED CONCRETE PRODUCTS

The present invention relates to a slip-form casting machine for fabrication of elongated concrete products.

The slip-form casting machine in accordance with the invention is capable of being used in the fabrication of elongated slip-form cast products, such as pillars, beams, pylons, cored structures, fence poles and the like.

The industrial production of elongated products aims to concentrate on products characterized by maximally rationalized and automated production methods and minimized material costs.

The conventional technology applied in the fabrication of elongated products is based on casting fluid concrete mix into prefabricated molds. The actual casting process takes place by feeding the fluid mix into a mold and then vibrating the mold either by manual methods or mechanical vibrators so as to achieve a sufficient degree of compaction for the concrete.

Disadvantages of prior art technology are its production method with a high proportion of manual work required and insufficient compaction technology, which requires a highly fluid concrete mix to be used in casting thereby necessitating a significantly increased hardening time and significantly higher comsumption of cement in order to achieve a comparable final strength. This kind of concrete also results in inferior fire- and low-temperature-resistance properties as well as reduced corrosion resistance in comparison with concretes produced from stiff concrete mix.

The aim of the present invention is to overcome the disadvantages associated with the aforedescribed prior art technology and achieve a entirely new kind of slip-form casting machine and method for production of elongated concrete products.

The invention is based on fabricating the elongated products by using ground-wet, extremely stiff concrete mix extruded into a closed, elongated, tubular mold.

The invention provides outstanding benefits.

Molded concrete surfaces become smooth and of high quality, also the final strength of concrete is improved significantly above the conventional grades. In addition, a longitudinal hollow core for weight reduction is easily formed into the product by means offered by the invention.

BRIEF DESCRIPTION OF THE DRAWINGS

In the following, the invention is examined in detail with help of the attached drawings illustrating an embodiment of the invention.

FIG. 2 shows a noise abatement wall and FIGS. 2A and 2B show possible cross-sections of poles suitable for construction of the wall.

FIG. 3 shows a shell construction for protection of steel reinforcements and FIGS. 3A and 3B show possible cross-sections of the shell.

FIG. 4 shows a fence with its poles manufactured using concrete elements fabricated in a slip-form casting machine in accordance with the invention.

FIG. 5 shows telephone line poles manufactured using a slip-form casting machine in accordance with the invention.

FIG. 6 shows railway bed blocks manufactured using a slip-form casting machine in accordance with the invention.

DETAILED DESCRIPTION

Figure 1:
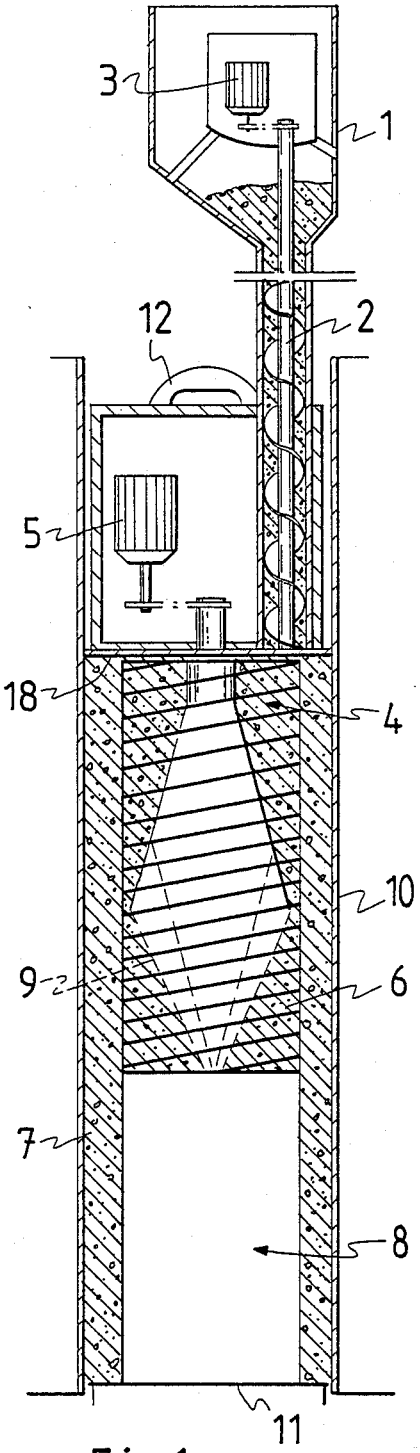
FIG. 1 shows a cross-sectioned side view of a slip-form casting machine in accordance with the invention.

FIG. 1 illustrates a typical slip-form casting machine for producing an elongated element. The casting machine moves in a tubular mold 10, which is closed at its one end by a mold bottom element 11, and fabricates elongated casts products. The casting machine is hoistable from above the mold 10 by a hoisting eyelet 12. The actual casting process is started by filling a concrete storage container 1, which also performs as a concrete feeding hopper, with stiff, ground-wet concrete. Then, a motor 3 actuating a feeder screw 2 is started to transfer concrete mix by means of the feeder screw 2 into an actual extruding space 4. Simultaneously is started a motorized drive mechanism 5 which actuates the casting machine as well as delivers power to rotate the auger 6 and thus implements the feed and compaction operations in the mix fed into the mold 10. The auger 6 is rotatably mounted on bearings on the machine body 18, which is substantially complementary with the cross section of the mold 10 and is movable with respect to the cross section of the casting mold 10. The auger 6 is appropriately shaped to develop from the rotational movement a simultaneously feeding and compacting effect, thereby disposing of the use of any auxiliary vibrating equipment. However, if necessary, vibrating equipment are easily adapted within the body of the auger 6. During the start of casting, the auger 6 typically rests against the mold bottom 11. While rotating, feeding, and compacting the mix, the auger 6 achieves a reactive counterpressure in an already compacted concrete 7, thereby forcing the casting machine to longitudinally retract in the tubular mold 10. Consequently, the casting operation is performed in the fashion of a continuous slip-form casting until a desired concrete element is ready cast.

As described, the feed of concrete mix into the mold 10 is based on an extrusion method. The auger 6 feeds the mix into the mold and simultaneously compacts the concrete into a desired degree of compaction. The method uses extremely stiff concrete mix allowing the cast concrete to retain its desired shape in the mold 10, furthermore making it possible, when necessary, to form a hollow core 8 longitudinally in the element. The cross-sectional dimension and the thickness of a wall 7 are alterable by adjusting either the size of the mold 10 or the shape of the auger 6.

Thus, the structure of a product manufactured by the slip-form casting machine may be a hollow-cored, simple core structure or, by means of an alternative adaptation, a massive elongated concrete product. In the latter case, the end part of the auger 6 is tapered into a wedge denoted by dashed lines 9 allowing the space left by auger 6 to be filled as the slip-form casting machine retracts.

The actual casting operation is most advantageously performed in vertical molds, but the system can also be applied to the manufacture of horizontal elongated structures of tubular shape. In the latter case, the concrete mix hopper 1 is obviously placed in a different manner allowing the hopper 1 to be filled from above.

The mold construction may also be arranged opening to the side so that the stiff, undeformable concrete product may be stripped from the mold immediately after casting and transferred to a heat curing oven thus facilitating the reuse of the mold. Consequently, a slip-form casting machine in accordance with the invention is applicable to an optimized production of elongated cast structures in length quantities to be later trimmed as appropriate for different applications.

Practical applications for products fabricated using a slip-form casting machine in accordance with invention are to be found in a multitude. Thus, poles of the noise abatement wall illustrated in FIG. 2 may be manufactured using concrete elements fabricated in a slip-form casting machine in accordance with the invention. The actual cross-sectional shape can be selected according to need, with possible cross-sections illustrated in FIGS. 2A and 2B. Illustrated in FIG. 3 is a protective hollow-cored shell structure 14 for fire and corrosion protection of steel reinforcements. In this case, the choice of concrete mix qualities is dictated by the degree of protection needed. Possible cross-sectional shapes of shell constructions are illustrated in FIGS. 3A and 3B. Illustrated in FIG. 4 is a fence construction in which easily decomposing wood poles and rusting steel poles are replaced by concrete poles 15 fabricated with help of a casting machine in accordance with the invention. Such electric line, telephone line and lighting poles 16 as illustrated in FIG. 5 are feasible to be manufactured using a slip-form casting machine of the aforedescribed construction. As illustrated in FIG. 6, a slip-form casting machine is also advantageously adaptable in the production of railroad bed blocks 17 cast of concrete. In this case, the cast products are posttensioned through the hollow core of the block thus making the construction a reinforced structure.

What is claimed is:

1. A slip-form casting machine for fabrication of elongated concrete products, comprising:

a casting mold which defines an elongate cavity and has first and second opposite ends, the mold being plugged at its first end, a casting machine body of which the external cross-sectional form is substantially complementary to the cross-sectional form of the cavity defined by the mold, the casting machine body being positioned inside the cavity and being movable therein longitudinally of the cavity, and having a first side directed towards the first end of the mold and a second side directed away from the first end of the mold, an auger positioned in the mold cavity between the first side of the casting machine body and the first end of the mold, the auger being supported by the casting machine body and being rotatable relative to the mold, and means for feeding concrete into the mold cavity between the auger and the first side of the casting machine body, whereby the auger exerts pressure on the concrete as the auger rotates.

2. A machine according to claim 1, wherein the auger is tapered into a wedge shape towards the first end of the mold in order to facilitate the fabrication of massive elongated products.

3. A machine according to claim 1, wherein the casting machine body comprises a drive motor coupled to the auger for rotating the auger.

4. A machine according to claim 1, wherein the mold is disposed vertically with its first end below its second end.

* * * * *